US008963075B2

(12) United States Patent
Chen et al.

(10) Patent No.: US 8,963,075 B2
(45) Date of Patent: Feb. 24, 2015

(54) BIOPARTICLE IONIZATION WITH PRESSURE CONTROLLED DISCHARGE FOR MASS SPECTROMETRY

(75) Inventors: Chung Hsuan Chen, Taipei (TW); Wen-Ping Peng, Taipei (TW); Ming Lee Chu, Sijhih (TW); Huan Cheng Chang, Taipei (TW); Huan-Chang Lin, Fongllin Township, Hualien County (TW)

(73) Assignee: Academia Sinica, Taipei (TW)

( * ) Notice: Subject to any disclaimer, the term of this patent is extended or adjusted under 35 U.S.C. 154(b) by 519 days.

(21) Appl. No.: 12/314,520

(22) Filed: Dec. 11, 2008

(65) Prior Publication Data

US 2009/0189069 A1 Jul. 30, 2009

Related U.S. Application Data

(60) Provisional application No. 61/013,408, filed on Dec. 13, 2007.

(51) Int. Cl.
*H01J 49/00* (2006.01)
*H01J 49/42* (2006.01)

(52) U.S. Cl.
CPC ..... *H01J 49/4265* (2013.01)
USPC ..... 250/282; 250/288

(58) Field of Classification Search
USPC ..... 250/281, 282, 288, 287, 290–292
See application file for complete search history.

(56) References Cited

U.S. PATENT DOCUMENTS

| | | | | |
|---|---|---|---|---|
| 4,709,148 | A * | 11/1987 | Meddings | 250/292 |
| 5,383,019 | A * | 1/1995 | Farrell et al. | 356/316 |
| 5,572,022 | A | 11/1996 | Schwartz | |
| 5,591,969 | A * | 1/1997 | Park et al. | 250/287 |
| 5,729,014 | A * | 3/1998 | Mordehai et al. | 250/282 |
| 5,843,603 | A * | 12/1998 | Ando et al. | 250/396 R |
| 6,049,086 | A * | 4/2000 | Foggiato et al. | 250/504 R |
| 6,262,638 | B1 | 7/2001 | Scherer | |
| 6,534,765 | B1 * | 3/2003 | Robb et al. | 250/288 |
| 6,646,256 | B2 | 11/2003 | Gourley et al. | |
| 6,710,334 | B1 * | 3/2004 | Twerenbold | 250/286 |
| 6,906,320 | B2 | 6/2005 | Sachs et al. | |
| 7,084,396 | B2 | 8/2006 | Schneider | |
| 7,161,147 | B1 | 1/2007 | Chang et al. | |
| 7,329,866 | B2 | 2/2008 | Wang | |
| 7,619,217 | B2 * | 11/2009 | Shea et al. | 250/288 |
| 2003/0071035 | A1 * | 4/2003 | Brailove | 219/672 |

(Continued)

FOREIGN PATENT DOCUMENTS

| | | |
|---|---|---|
| WO | WO2008/042949 (A2) | 4/2008 |

OTHER PUBLICATIONS

Fuerstenau et al. ("Megadalton ions by charge detection TOFMS" Rapid Comm in Mass Spec. vol. 9, 1528-1538, 1995).*

(Continued)

*Primary Examiner* — Brooke Purinton

(74) *Attorney, Agent, or Firm* — Eckman Basu LLP

(57) ABSTRACT

A novel system and method for charge-monitoring mass spectrometry is provided. The mass spectrometer can be used to measure the mass of one or more analytes having masses in the range of about a few Daltons to more than about $10^{15}$ Daltons. The invention can be used for rapid mass distribution measurements. For example, the system and method can be used to distinguish cancer cells from normal cells when their mass distributions are different.

9 Claims, 20 Drawing Sheets

(56) References Cited

U.S. PATENT DOCUMENTS

| | | | | |
|---|---|---|---|---|
| 2003/0122070 | A1 | 7/2003 | Chang et al. | |
| 2004/0031917 | A1* | 2/2004 | Hager | 250/282 |
| 2005/0029448 | A1* | 2/2005 | Chang et al. | 250/292 |
| 2005/0153341 | A1 | 7/2005 | Alexander | |
| 2005/0163816 | A1* | 7/2005 | Agrawal et al. | 424/423 |
| 2005/0242279 | A1* | 11/2005 | Verentchikov | 250/287 |
| 2006/0219897 | A1* | 10/2006 | Schneider | 250/288 |
| 2006/0284074 | A1 | 12/2006 | Chang et al. | |
| 2007/0023677 | A1* | 2/2007 | Perkins et al. | 250/425 |
| 2007/0131871 | A1 | 6/2007 | Chang et al. | |
| 2007/0272852 | A1 | 11/2007 | Miller | |
| 2007/0295902 | A1* | 12/2007 | Shea et al. | 250/288 |
| 2008/0149821 | A1 | 6/2008 | Senko | |
| 2008/0304522 | A1* | 12/2008 | Mills | 372/5 |

OTHER PUBLICATIONS

Alex R. Dow, Ashley M. Wittrig and Hilkka I. Kenttämaa, "Laser-induced acoustic desorption (LIAD) mass spectrometry" European Journal of Mass Spectrometry. vol. 18, Issue 3, 2012, pp. 77-92. doi: 10.1255/ejms.1162.*

International Search Report for PCT Application No. PCT/US08/86441, Examiner Lee W. Young (Feb. 6, 2009).

Induction Charge Detector With Multiple Sensing Stages, *NASA's Jet Propulsion Laboratory*, www.techbriefs.com/component/content/article/2540-npo-44736?tmpl=component&print=1&page= (Jan. 1, 2008).

B. Bothner et al., "Electrospray ionization of a whole virus: analyzing mass, structure, and viability," *ChemBioChem 5*:258-60 (2004).

Y. Cai et al. "Ion trap mass spectrometry of fluorescently labeled nanoparticles," *Anal. Chem. 75*:1805-11 (2003).

J. L. Campbell et al., "Analysis of polyethylene by using cyclopentadienyl cobalt chemical ionization combined with laser-induced acoustic desorption/fourier transform ion cyclotron resonance mass spectrometry," *Anal. Chem. 77*: 4020-6 (2005).

R. Chen et al., "Trapping, detection, and mass determination of coliphage T4 DNA ions of $10^8$ Da by electrospray ionization fourier transform ion cyclotron resonance mass spectrometry", *Anal. Chem. 67*: 1159-1163 (1995).

S.D. Fuerstenau et al., "Molecular weight determination of mega-Dalton electrospray ions using charge detection time-of-flight mass spectrometry," *Rapid Comm. Mass Spectrom.*, 9:1528-1538 (1995).

D. Fuerstenau et al., "Mass spectrometry of an intact virus," W. H. Benner, J. J. Thomas, C. Brugidou, B. Bothner, G. Siuzdak, *Angew. Chem. Int. Ed. 40*: 542-4 (2001); Corrigendum: *Angew. Chem. Int. Ed. 40*: 982 (2001).

S.D. Fuerstenau, "Whole Virus Mass Analysis by Electrospray Ionization," *J. Mass. Spectrom. Soc. Japan.*, 51:50-53 (2001).

P. W. Geno et al., "Secondary electron emission induced by impact of low-velocity molecular ions on a microchannel plate," *Int. J. Mass Spectrom. Ion Processes 92*: 195-210 (1989).

V. V. Golovlev et al., "Laser-induced acoustic desorption," *Int. J. Mass Spectrom. Ion Processes 169/170*: 69-78 (1997).

V. V. Golovlev et al., "Laser-induced acoustic desorption of electrons and ions", *Appl. Phys. Lett. 71*: 852 (1997).

E. de Hoffmann et al., *Mass Spectrometry: Principles and Applications*, 3rd Ed. Wiley and Sons, Ltd., Hoboken, NJ. Chapters 1-3 (2007).

M. Karas et al., "Laser desorption ionization of proteins with molecular masses exceeding 10,000 Daltons," *Anal. Chem.*, 60:2299-301 (1988).

J. L. Jimenez et al., "Ambient aerosol sampling using the Aerodyne aerosol mass spectrometer," *J. Geophys. Res. Atmos. 108*: 8425-37 (2003).

K. M. Lue et al., "Quadrupole mass spectrometer measurements of electrostatic sprays," *Inst. Phys. Conf. Series 85*: 337-342 (1987).

Mohammed A. Meetani et al., "Desorption electrospray ionization mass spectrometry of intact bacteria," *Journal of Mass Spectrometry*, 42:1186-1193 (2007).

Z. Nie et al., "Microscopy-based mass measurement of a single whole virus in a cylindrical ion trap," *Angew. Chem. Int. Ed. 45*: 8131 (2006).

Wen-Ping Peng et al., "Molar mass and molar mass distribution of polystyrene particle size standards," *Anal. Chem.*, 77: 7084-7089 (2005).

Wen-Ping Peng et al., "Laser-Induced Acoustic Desorption Mass Spectrometry of Single Bioparticles," *Angewandte Chemie*, 118:1451-1457 (2006).

Wen-Ping Peng et al., "Charge-Monitoring Laser-Induced Acoustic Desorption Mass Spectrometry for Cell and Microparticle Mass Distribution Measurement," *Angew. Chem. Int. Ed.*, 46:3865-3869 (2007).

R. Redmer, "Physical properties of dense, low-temperature plasmas," *Phys. Reports*, 282:35-157 (1997).

L. Salsac, et al., Glow Discharges: Glow Discharges in low-pressure gases, *SARL Atout & Progrés, Paris, France*, www.glow-discharge.com/Discharges_1.html (Parts first published online Oct. 17, 2006 and Sep. 12, 2007).

J. C. Schultz et al., "Mass determination of megadalton-DNA electrospray ions using charge-detection mass spectrometry," *J. Am. Soc. Mass Spectrom. 9*: 305-313 (1998).

R. C. Shea et al., "Characterization of laser-induced acoustic desorption coupled with a fourier transform ion cyclotron resonance mass spectrometer," *Anal. Chem. 78*: 6133-9 (2006).

H. Shelton et al., "Electrostatic acceleration of microparticles to hypervelocities," *J. Appl. Phys. 31*: 1243-46 (1960).

G. Siuzdak, *The Expanding Role of Mass Spectrometry in Biotechnology*, 2nd Ed. MCC Press, San Diego. Chapters 1-2 (2006).

J. Somuramasami et al., "Evaluation of a Novel Approach for Peptide Sequencing: Laser-Induced Acoustic Desorption Combined with $P(OCH_3)_2^+$ Chemical Ionization and Collision-activated Dissociation in a Fourier Transform Ion Cyclotron Resonance Mass Spectrometer," *J Am Soc Mass Spectrom.* 18(3):525-40. (Mar. 2007) (Epub Dec. 6, 2006).

K. Tanaka et al., "Protein and polymer analyses up to m/z 100 000 by laser ionization time-of-flight mass spectrometry," *Rapid Commun. Mass Spectrom. 2*: 151-153 (1988).

M. A. Tito et al., "Electrospray time-of-flight mass spectrometry of the intact MS2 virus capsid," *J. Am. Chem. Soc. 122*: 3550-51 (2000).

S. F. Wong et al., "Multiple charging in electrospray ionization of poly(ethylene glycols)," *J. Phys. Chem. 92*, 546-50 (1988).

QIN, Anal Chem 1996 vol. 68, pp. 2108-2112.

* cited by examiner

BIOPARTICLE IONIZATION WITH PRESSURE CONTROLLED DISCHARGE FOR MASS SPECTROMETRY

This application claims priority under 35 U.S.C. 119(e) to U.S. Provisional Application 61/013,408, filed Dec. 13, 2007, which is incorporated herein by reference.

I. FIELD OF THE INVENTION

The disclosure herein generally relates to the field of mass spectrometry, and, more particularly, to a novel charge-monitoring mass spectrometry system and method for increasing the speed, ease, detection efficiency, and precision with which mass measurements of analytes ranging from molecules to cells and microparticles can be performed.

II. BACKGROUND

Spectrometry is the art of inferring information about an analyte based on its interaction with electromagnetic fields and radiation. Mass spectrometry, as its name suggests, is concerned with measurements of mass. Mass spectrometers (MS) have been called the smallest scales in the world because some of them can 'weigh' a single atom. Over time, the use of mass spectrometry has been expanded to larger and larger molecules, including macromolecules.

Nobel Laureate John B. Fenn remarked, "mass or weight information is sometimes sufficient, frequently necessary, and always useful in determining the identity of a species." As mass spectrometry has become compatible with larger and larger analytes, this statement has remained true, with MS being used frequently to identify macromolecular components in biochemical mixtures. In the post-genomic era, there is more interest than ever in the characterization of increasingly massive macromolecular assemblies, and even larger bioparticles such as viruses and whole cells.

The masses of intact bioparticles, including viruses, bacteria, and whole mammalian cells have indeed been measured with mass spectrometers employing soft desorption techniques, such as laser-induced acoustic desorption (LIAD). A mass analyzer employing a trap may be used for light-scattering measurements to determine the mass-to-charge ratio (m/z) for these desorbed bioparticles. To determine masses of these bioparticles, the number of charges of the desorbed microparticles needs to be changed by electron bombardment in order to observe changes in their light-scattering patterns. One problem with this approach is that this process of changing the number of charges can be excessively time consuming. For example, on average it takes about 15-30 minutes to determine the mass of one trapped microparticle. As mass distributions of most bioparticles are broad and many microparticles have to be measured to obtain a mass distribution, it becomes impractical to perform conventional light-scattering techniques for mass-distribution measurements of microparticles.

An additional problem with previous approaches relates to noise levels and precision of charge measurement. A single microparticle can have charge numbers in the range of 10-2,000 under matrix-assisted laser desorption-ionization (MALDI) or LIAD measurement processes. However, accurate determination of mass by direct measurement of the number of charges on these desorbed cells or microparticles has been a challenge because of the low number of charges on the cells or microparticles relative to electronic noise due to the detection apparatus.

In most conventional mass spectrometers, ions are detected by a charge-amplification device, such as a microchannel plate ("MCP"). Because the charge-amplification device detects charges based on ejection of secondary electrons, this type of detector is typically associated with an undesired detection bias. Moreover, the efficiency of secondary-electron ejection is closely related to the velocity of the incoming ions. Therefore, mass spectra of mixtures of large biomolecules usually do not reflect the actual number of ions detected at a charge-amplification device.

III. SUMMARY

An apparatus and method for performing charge-monitoring mass spectrometry are disclosed. In one embodiment, the apparatus includes components for mounting and desorbing/vaporizing the analyte; components for enhancing the electrostatic charge of the analyte; a mass analyzer for determining the mass to charge (m/z) ratio of the analyte based on its interactions with an electric and/or magnetic field; and a charge detector to measure the charge of the analyte. In some embodiments, certain components may perform or contribute to more than one of the above roles.

In another embodiment, the apparatus includes components for Laser-Induced Acoustic Desorption of the analyte; a mass analyzer for determining the mass to charge (m/z) ratio of the analyte based on its interactions with an electric and/or magnetic field; and a charge detector to measure the charge of the analyte.

In still another embodiment, the method includes desorbing and/or vaporizing an analyte; enhancing the charge of the analyte; subjecting the analyte to an electric and/or magnetic field and using the interactions of the analyte with that field to determine its mass to charge ratio; measuring the charge on the analyte; and calculating the mass of the analyte based on the foregoing measurements. The method may vary according to different types of analytes and different configurations of the apparatus.

In a further embodiment, the method includes Laser-induced Acoustic Desorption of the analyte; subjecting the analyte to an electric and/or magnetic field and using the interactions of the analyte with that field to determine its mass to charge ratio; measuring the charge on the analyte; and calculating the mass of the analyte based on the foregoing measurements.

The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

IV. BRIEF DESCRIPTION OF THE DRAWINGS

The drawings, which are incorporated in and constitute a part of this specification, illustrate embodiments of the principles of the present invention and together with the description, serve to explain the principles of the invention. Wherever possible, the same reference numbers will be used throughout the drawings to refer to the same or like parts.

FIG. 1A is a schematic block diagram of an exemplary charge-monitoring mass spectrometer system that may be used in accordance with the disclosed embodiments. The system includes a quadrupole ion trap, a pulsed YAG laser, a He—Ne laser, a charge detector, and a CCD camera. The Nd-Yag laser is to achieve cell desorption via LIAD. The He—Ne laser is to illuminate trapped cells so that they can be detected by the CCD camera.

FIG. 1B is an exemplary optical image of exemplary trapped cell light-scattering patterns that may be measured in accordance with the disclosed embodiments.

FIGS. 2A-B are a circuit design of an exemplary charge detector that may be used in accordance with the disclosed embodiments. The element is laid out on a 44 mm by 44 mm PCB board.

V. DETAILED DESCRIPTION OF THE EMBODIMENTS

A. Apparatus

Figure 1A:
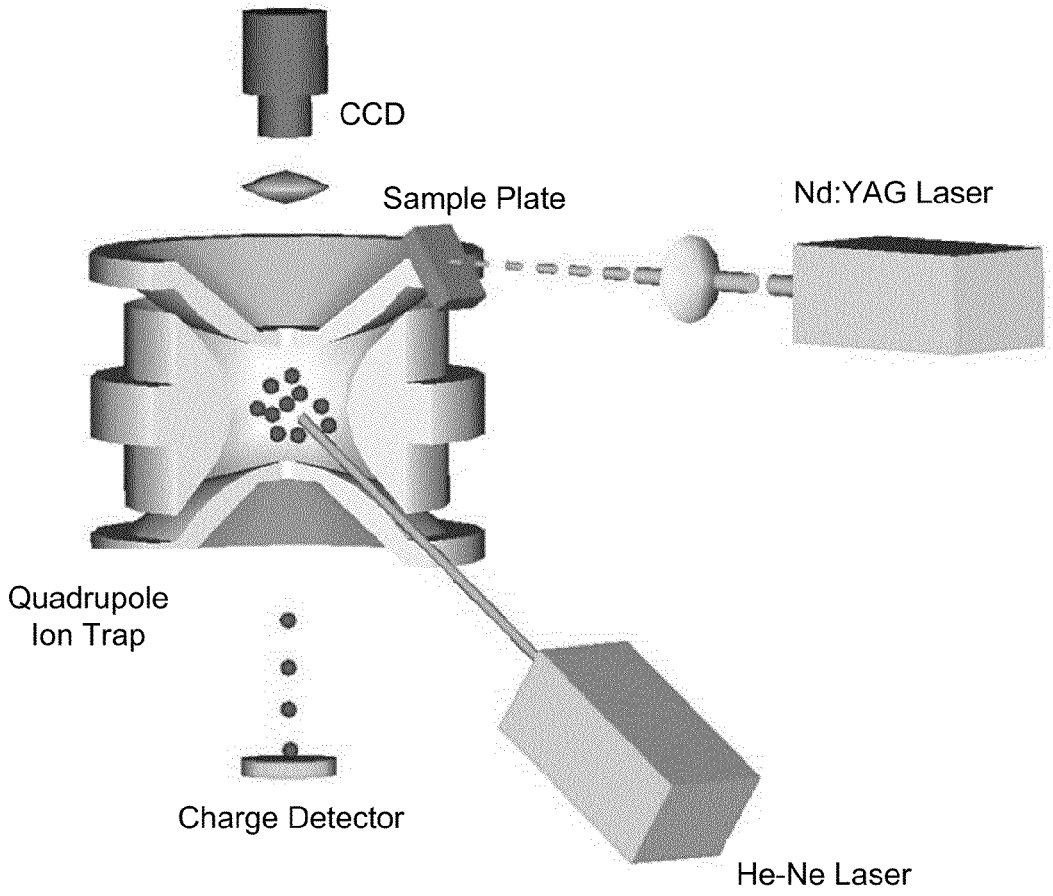

Reference will now be made in detail to the disclosed embodiments of the invention. The present invention overcomes the disadvantages of the prior art by providing a novel charge-monitoring mass spectrometry system and method that increases the speed with which mass measurements can be performed, e.g., by orders of magnitude relative to light-scattering techniques. To that end, the invention increases the number of charges on an analyte by more than one order of magnitude compared with prior measurement techniques, thereby increasing the signal-to-noise ratio of its mass measurement. Accordingly, the number of charges on the analyte can be rapidly and directly measured without requiring conventional charge amplification at the charge detector.

1. Analyte Introduction

Mass spectrometric analysis generally requires that the analyte be vaporized into the gas phase for subsequent analysis, particularly by the mass analyzer. The invention relates to mass spectrometers that achieve this in a number of ways.

a) Desorption

Desorption is a commonly used process to vaporize analyte into the gas phase. Multiple types of desorption may be used in accordance with the invention. Laser-Induced Acoustic Desorption (LIAD)[1] may be used by configuring the apparatus with a substrate on which the analyte may be mounted, without an underlying matrix. Laser irradiation of the substrate may be used to desorb the analyte from the substrate, such that the analyte enters the gas phase and is subject to the electric and/or magnetic fields generated by other components of the apparatus.

[1] W.-P. Peng, Y.-C. Yang, M.-W. Kang, Y.-K. Tzeng, Z. Nie, H.-C. Chang, W. Chang, C.-H. Chen, Laser-Induced Acoustic Desorption Mass Spectrometry of Single Bioparticles, *Angewandte Chemie* 118:1451-1454 (2006).

Matrix-Assisted Laser Desorption Ionization (MALDI)[2] may be used by configuring the apparatus with a substrate on which the analyte may be mounted, with an underlying matrix comprising a light-absorbing chemical, such as 2,5-dihydroxy-benzoic acid, 3,5-dimethoxy-4-hydroxycinnamic acid, 4-hydroxy-3-methoxycinnamic acid, α-cyano-4-hydroxycinnamic acid, picolinic acid, 3-hydroxy-picolinic acid, or the like. Laser irradiation of the matrix may be used to desorb the analyte from the substrate.

[2] M. Karas, F. Hillenkamp. Laser desorption ionization of proteins with molecular masses exceeding 10,000 Daltons. *Anal Chem,* 60:2299-301 (1988).

Other versions of desorption include, without limitation, Surface-Enhanced Laser Desorption Ionization (SELDI), Desorption-Ionization On Silicon (DIOS), Desorption Electrospray Ionization (DESI), Plasma Desorption, and Field Desorption (FD). Additional modes of desorption are also included within this invention.[3]

[3] See, e.g., G. Siuzdak, *The Expanding Role of Mass Spectrometry in Biotechnology* (2nd Ed., MCC Press, 2006), or E. de Hoffman and V. Stroobant, *Mass Spectrometry: Principles and Applications* (3rd Ed., John Wiley & Sons Inc., 2007).

b) Alternatives to Desorption

Other methods by which analyte may be introduced to the gas phase include, without limitation, Electron Ionization (EI), Chemical Ionization (CI), Field Ionization (FI), Fast Atom Bombardment (FAB), Ion Attachment Ionization (IA), Electrospray (ES), Thermospray (TS), Atmospheric Pressure Ionization (API), Atmospheric Pressure Photoionization (APP), Atmospheric Pressure Chemical Ionization (APCI), and Direct Analysis in Real Time (DART). Additional modes of introducing the analyte into the gas phase are also included within this invention.[4]

[4] See, e.g., G. Siuzdak, *The Expanding Role of Mass Spectrometry in Biotechnology* (2nd Ed., MCC Press, 2006); E. de Hoffman and V. Stroobant, *Mass Spectrometry: Principles and Applications* (3rd Ed., John Wiley & Sons Inc., 2007).

2. Charge Enhancer

In certain embodiments, the invention may involve enhancing the number of charges on the analyte. This feature reduces the effect of background electronic noise on the precision of measurement of charge. It renders the use of secondary charge detection techniques unnecessary, eliminating the detection bias that such techniques may introduce. Thus, it facilitates the subsequent determination of analyte mass, with greater precision and less bias than would be possible with analytes charged only in the initial vaporization/desorption step. Two modes of charge enhancers are described below; however, additional modes are also included within this invention. Additionally, the apparatus of the invention may be constructed, and the corresponding methods carried out, without the use of a charge enhancer or a charge enhancement step.

a) Discharge

The charge enhancement feature of the invention may be realized through the use of a discharge. Discharge phenomena may arise from formation of a plasma through ionization of a gas. Exposure of the analyte to the plasma created by the discharge may be used to increase the absolute charge on the analyte.

The type of discharge may be a corona discharge. A corona discharge occurs when fluid (such as gas) surrounding a conductor is subject to an electric field strong enough to cause some ionization of the fluid without arcing or complete electrical breakdown. The analyte may be vaporized into an inert gas at a pressure of approximately 10 to 100 mTorr. Without limitation, usable gases may include helium, neon, argon, krypton, xenon, nitrogen, hydrogen, and methane. The buffer-gas pressure may be fine-tuned to generate the corona discharge. The discharge may be produced near the desorption plate or sample inlet of the instrument. The discharge may occur upon use of a laser, such as would be used in laser desorption processes, when the apparatus is also generating a radio frequency (RF) voltage with a peak amplitude higher than 1000 V and the gas pressure is higher than a few milli-Torr.

The gas may be introduced from a pressurized source with a pressure regulating device such as a regulator and flow rate controlling device such as a needle valve. A turbo pump coupled with a mechanical pump may be used to pump out gas. The equilibrium pressure may result from the combination of the input of the gas and its removal by the pumps.

When a mild corona discharge occurs using helium buffer gas, a blue and white plasma may be observed; for example, with an apparatus equipped with a LIAD desorption plate and a Quadrupole Ion Trap (QIT), the plasma may appear between the desorption plate and the ion trap. When the apparatus generates a time-varying electromagnetic field, an oscillation of plasma driven by the frequency of said field may be observable, e.g., using an oscilloscope. With this mild corona discharge, the number of charges attached to an analyte may be increased. The increase may be by one to two orders of magnitude, or more. For example, in one embodiment, the number of charges may be increased by 2, 3, 4, 5, 7, 10, 20, 30, 40, 50, 60, 70, 80, 90, 100, or more times. The degree of increase in charge may depend on the particle size, particle material, and experimental conditions. Both positively and negatively charged analytes can be observed using this exemplary experimental setup.

Other types of discharges may also be usable in a similar manner, including but not limited to cold cathode discharge, hollow cathode discharge, DC-induced discharge, radio frequency (RF)-induced discharge, and glow discharge. For example, application of different levels of RF power may excite the gas and result in plasma formation with concomitant discharge, depending on the design and what type of discharge is used. In one instance, 10-200 watts for RF power are used; in another instance, 25-150, 10-150, 25-100, 50-75, or 10-300 watts of RF power are used.

b) Charged Particle Beam

Charge enhancement may be carried out by exposure of the analyte to a beam of charged particles, such as ions or electrons. The charged particles may be of a sufficiently low energy (for example, less than or equal to 1 eV) so as not to compromise subsequent mass determination by degradation of or damage to the analyte. The analyte may acquire charge from the charged particles by capture or by charge transfer.

3. Mass Analyzer

The mass analyzer may use an electromagnetic field to sort analytes in space or time according to their mass to charge ratio. The invention may relate to mass spectrometers employing many types of mass analyzer.

a) Ion Trap-Based Analyzer

The analyte may be analyzed in an ion trap. This type of mass analyzer may subject the analyte to an electric field oscillating at a radio frequency (RF) and the electrodes of the trap may additionally have a DC bias, for example, of around 2000 V.

The ion trap may be a three-dimensional quadrupole ion trap, also known as a Paul Ion Trap, which may have end cap electrodes and a ring electrode. The end cap electrodes may be hyperbolic. The end cap electrodes may be ellipsoid. Holes may be drilled in the end cap electrodes to allow observation of light scattering and through which analyte may be ejected. The frequency of oscillation may be scanned to eject analyte from the trap according to its mass to charge ratio.

The ion trap may be a linear ion trap (LIT), also known as a two dimensional ion trap. The linear ion trap may have four rod electrodes. The rod electrodes may cause oscillation of analyte in the trap through application of an RF potential. An additional DC voltage may be applied to the end parts of the rod electrodes to repel analyte toward the middle of the trap. The linear ion trap may have end electrodes placed near the ends of the rod electrodes, and these end electrodes may be subject to a DC voltage to repel analyte toward the middle of the trap. Analyte may be ejected from the linear ion trap. Ejection may be accomplished axially using fringe field effects generated, for example, by an additional electrode near the trap. Ejection may be accomplished radially through slots cut in rod electrodes. The LIT may be coupled with more than one detector so as to detect analyte ejected axially and radially.

b) Time of Flight

The mass analyzer may be a time-of-flight analyzer. The time of flight analyzer may include electrodes to generate an electric field in one region to accelerate the analyte, followed by a field-free region, followed by a detector. The time of flight analyzer may be a reflectron time of flight analyzer, in which a reflectron or electrostatic reflector may increase the total flight length and time of the analyte. The time of flight analyzer may operate by delayed pulse extraction, in which the accelerating field is controlled in a manner to correct ion energy dispersion and/or is present only after a delay following absorption. The time of flight analyzer may operate by continuous extraction, in which the accelerating field is continuously present in its region during analysis.

c) Other Mass Analyzers

Additional mass analyzers that may be adapted for use with the invention include, without limitation, quadrupole, magnetic sector, orbitrap, and ion cyclotron resonance analyzers.[5] Further mass analyzers are also included in this invention.

[5] See, e.g., G. Siuzdak, *The Expanding Role of Mass Spectrometry in Biotechnology* (2nd Ed., MCC Press, 2006); E. de Hoffman and V. Stroobant, *Mass Spectrometry: Principles and Applications* (3rd Ed., John Wiley & Sons Inc., 2007).

4. Charge Detector

The total number of charges (z) on the analyte may be detected using a compact and low-noise charge detector coupled to the mass analyzer. The electronic noise at the detector may be reduced by cooling its detector electronics. The mass (m) of the analyte can be determined based on the measured m/z and z values.

a) Charge Detection Plate

The charge detector may comprise a conducting plate or cup and a charge-integrator circuit. In one disclosed embodiment, the charge-integrator circuit may include, among other things, a low-noise JFET transistor as the charge-sensitive detector (i.e., input stage), at least one operational amplifier (AD8674 Analog Devices, USA) to amplify the detected charge signal, and some basic low-pass filtering circuitry to filter low-frequency noise. The charge detector may comprise a Faraday plate or Faraday cup as the charge collector. For example, FIG. 2 shows an exemplary Faraday plate and charge-sensitive amplifier integrated on a small printed circuit board in accordance with a disclosed embodiment. The mechanical structure of the exemplary charge integrator may be directly integrated with the mass analyzer. The charge detector and its associated components may be shielded using a stainless steel sheet, and the analyte entrance to the detector may be shielded with a 1 $cm^2$ metal mesh connected to ground potential. The Faraday plate may be located about 2 cm from the exit of the ion trap.

b) Induction Charge Detector

In another disclosed embodiment, the charge detector may comprise an induction charge detector. The induction charge detector may be a single-stage or multiple stage device that yields one or more measurements of the electric charge of an analyte. The induction charge detector may also yield measurements of the time of flight of the analyte through the stage or stages of the detector. The sensor may include one or more conductive tubes or plates. The tubes may be collinear, cylindrical and of equal diameter. The plates may be arranged in parallel pairs. The entrance to the sensor may be a narrower tube that limits the number of entering particles, such as to one at a time, and ensures that their trajectories remain close to the cylindrical axis. As a charged particle enters each sensing tube, it induces a charge on the tube nearly equal to its own. Each sensing tube may be connected to an operational-amplifier circuit that senses the electric potential associated with the induced charge. The charge of the particle may be calculated from this electric potential and the capacitance of the tube.

B. Methods

The disclosed invention relates to a method for determining the mass and/or mass distribution of many types of samples, or analytes, using the apparatus of the invention. An analyte may be vaporized or desorbed, subjected to charge enhancement, have the mass to charge (m/z) ratio determined by a mass analyzer, and then have the charge determined by a charge detector. From these measurements, the mass may be calculated.

1. Mass Determination of Bioparticles

The disclosed invention further relates to a method for determining the mass and/or mass distribution of bioparticles such as, but not limited to, viruses, macromolecular complexes, ribosomes, organelles, mitochondria, chloroplasts, synaptosomes, chromosomes, or whole cells, which may include cancerous cells. The cells may also include bacterial cells, pollen grains, and spores, which may be bacterial, fungal, protist, or plant.

The bioparticles may be prepared for desorption and/or vaporization by washing and chemical fixation. The washing may be with an aqueous solution. The solution may be saline and buffered. One specific example is Dulbecco's phosphate-buffered saline; others are possible.

Fixation may be achieved using an aldehyde-containing crosslinking agent, such as paraformaldehyde, formaldehyde, glutaraldehyde, and similar molecules. Thereafter, the cells may be washed repeatedly, for example, three times in distilled deionized water and subsequently counted and resuspended prior to placement into the apparatus.

2. Mass determination of small molecules, nanoparticles, Microparticles, and Polymers The invention may be used to measure small molecules, such as nanoparticles likefullerenes ($C_{60}$), which are 1 nm in diameter. The invention may also be used to analyze microparticles ranging in size up to at least 30 μm. For example, this invention may be used to analyze microparticles in size from 1 μm to 30 μm, from 5 μm to 25 μm, from 10 μm to 20 μm, from 15 μm to 30 μm, from 20 μm to 30 μm, from 1 μm to 10 μm, or from 5 μm to 15 μm. These capabilities illustrate that the invention may be used to analyze polymers and other molecules with particle sizes over a range of more than four orders of magnitude in terms of diameter, which may correspond to 12 or more orders of magnitude or more in terms of volume and mass. The invention also may be used for performing other types of mass measurements, such as mass measurements of aerosols, organic polymers, dendrimers, fine particulate matter such as combustion products, and biopolymers.

3. Mass Spectrometric Analysis of Mixtures

Figure 6A:
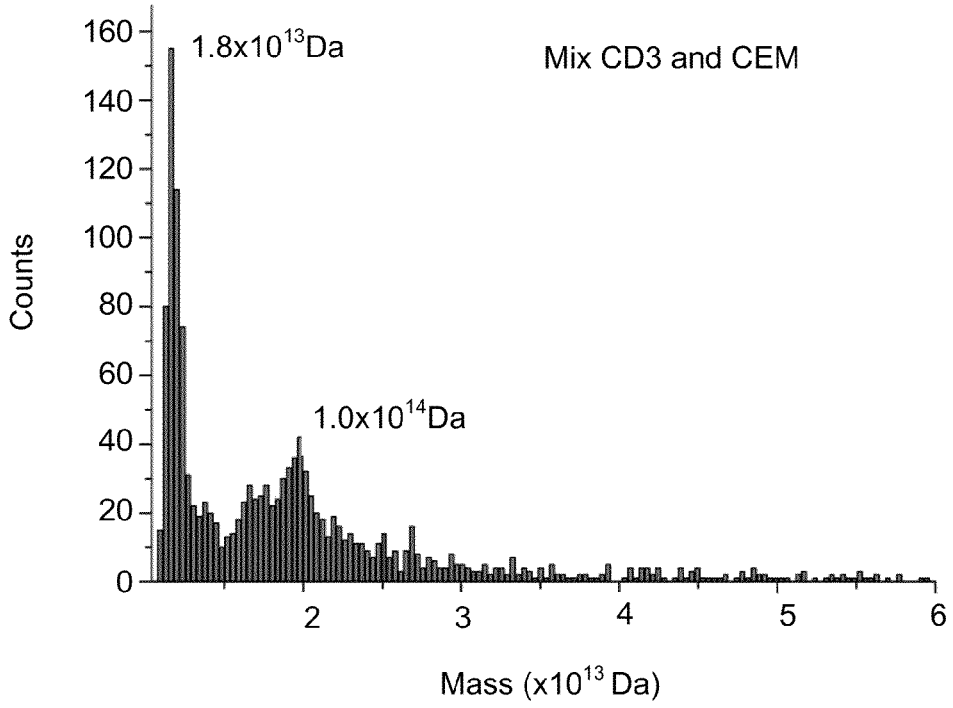
FIG. 6A is a histogram representation of an exemplary mass distribution of an equal ratio mixture of lymphocyte (CD3+ cells) and CEM cells that may be measured in accordance with the disclosed embodiments.

Advantageously, charge-monitoring mass spectrometry can be used not only to measure the mass of a single type of analyte, but also mixtures of analytes such as cells and/or microparticles. For example, FIG. 6A shows a histogram obtained from a mixed sample of CEM leukemia cells and normal lymphocytes (CD3+ cells) in accordance with a disclosed embodiment that is almost the same as that obtained by adding the individual spectra of CEM cells and lymphocytes.

VI. EXAMPLES

Example 1

Charge-Monitoring LIAD QIT MS

In one disclosed exemplary embodiment, the invention involves a combination of the following techniques: 1) laser-induced acoustic desorption of microparticles without a matrix, 2) a pressure-controlled corona discharge to enhance the number of charges on a cell or microparticle, 3) a low-frequency quadrupole ion trap for ultra-large m/z measurement, and 4) a compact and low-noise charge detector for total-charge measurement.

Figure 1B:
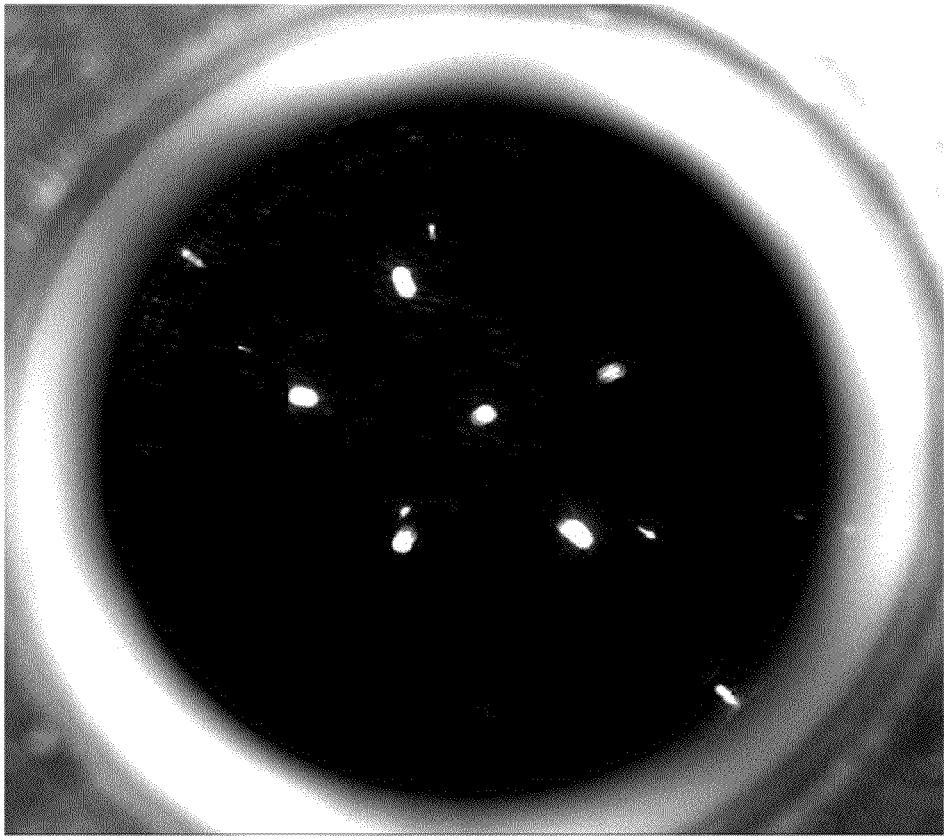

FIG. 1 shows an exemplary experimental setup in accordance with a disclosed embodiment. Samples of cells or microparticles were loaded directly onto a silicon wafer (thickness of approximately 0.5 mm) without a matrix. A frequency-doubled Nd:YAG laser beam (e.g., $\lambda$=532 nm, Laser Technik, Berlin, Germany) with a pulse duration of approximately 6 ns directly irradiated the backside of the sample plate to desorb the cells or microparticles by LIAD with a power density of around $10^8$ W $cm^{-2}$. The desorbed cells or microparticles were subsequently trapped (confined) in the quadrupole ion trap. Each end cap of the quadrupole ion-trap was drilled with a hole. One hole was be used for the collection of scattered laser light and the other for trapped cells or microparticles to exit the trap and subsequently be detected by a charge-detection plate. A He—Ne laser (e.g., $\lambda$=632 nm) may be used to illuminate the trapped cells or microparticles, and a charge coupled device ("CCD") may be installed to monitor the desorbed cells and microparticles in the ion trap.

In the exemplary QIT-MS shown in FIG. 1A, cells from the laser desorption were trapped in a helium buffer gas having a pressure of approximately 100 mTorr. A time-varying electromagnetic field having a frequency of approximately 350 Hz was applied to the desorbed cells and microparticles in the quadrupole ion trap. FIG. 1A shows an exemplary optical image of cells in the ion trap measured by a CCD camera. Owing to the small light collection angle of the CCD camera, the image size of each cell or microparticle may not necessarily reflect the true size of the cell or microparticle, but rather the extent of its stable trajectory. Some analyte inside the trap might not have been observable by the CCD camera because of the small solid angle for light collection.

A mild corona discharge was applied near the desorption plate to enhance the number of charges on the trapped analyte and, thus, reduce the effects of background electronic noise at the charge detector. The buffer-gas pressure was fine-tuned to generate the corona discharge. When a mild corona discharge occurred using the above-described helium buffer gas, a blue and white plasma was observed between the ion trap and desorption plate. An oscillation of plasma as driven by the audio frequency of the applied electromagnetic field was observable using an oscilloscope (not shown). With this mild corona discharge, the number of charges attached to the analyte was increased by one to two orders of magnitude depending on the particle size, particle material, and experimental conditions. Both positively and negatively attached microparticles were observed using this exemplary experimental setup. Mass-to-charge ratios were measured by scanning the electromagnetic-field frequency to eject charged particles with unstable trajectories.

The quadrupole ion trap was operated under an axial mass-selective instability mode by scanning the trap driving frequency in the range of about 20 Hz to a few megahertz. To that end, a voltage around 1520 V was initially applied using a high-voltage transformer driven by an audio-frequency power amplifier (not shown) and a functional generator (not shown). By scanning the applied audio frequency using the functional generator, analyte in the quadrupole ion trap was ejected from the trap along an axial direction. The number of charges on each ejected analyte was subsequently detected at a charge detection plate. The mass of the ejected analyte was determined according to the measurements of m/z and z for that analyte.

Example 2

Charge Detector

Figure 2A:
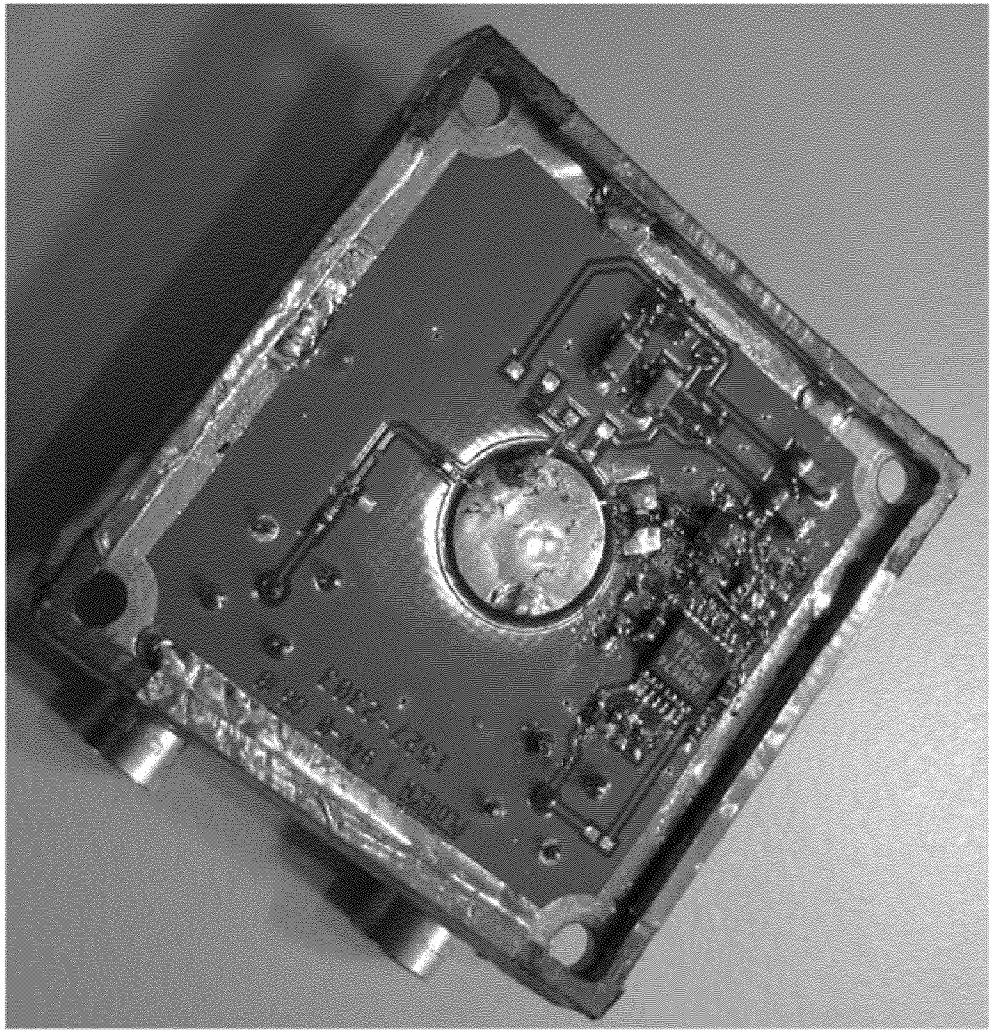

FIGS. 2A and B illustrate an exemplary charge detector that was used. This exemplary charge detector comprises a conducting plate and a charge-integrator circuit. The element was laid out on a 44 mm by 44 mm PCB board. This charge-integrator circuit included, among other things, a low-noise JFET transistor as the charge-sensitive detector (i.e., input stage), an operational amplifier (AD8674 Analog Devices, USA) to amplify the detected charge signal, and some basic low-pass filtering circuitry to filter low-frequency noise. The exemplary charge detector used a Faraday plate as the charge collector. FIG. 2A shows a Faraday plate and charge-sensitive amplifier integrated on a small printed circuit board. The mechanical structure of the charge integrator was directly integrated with the quadrupole ion trap. The Faraday detector and its associated components were shielded using a stainless steel sheet, and the cell or microparticle entrance to the detector was shielded with a 1 $cm^2$ metal mesh connected to ground potential. The Faraday plate was located about 2 cm from the exit of the ion trap.

Figure 2B:
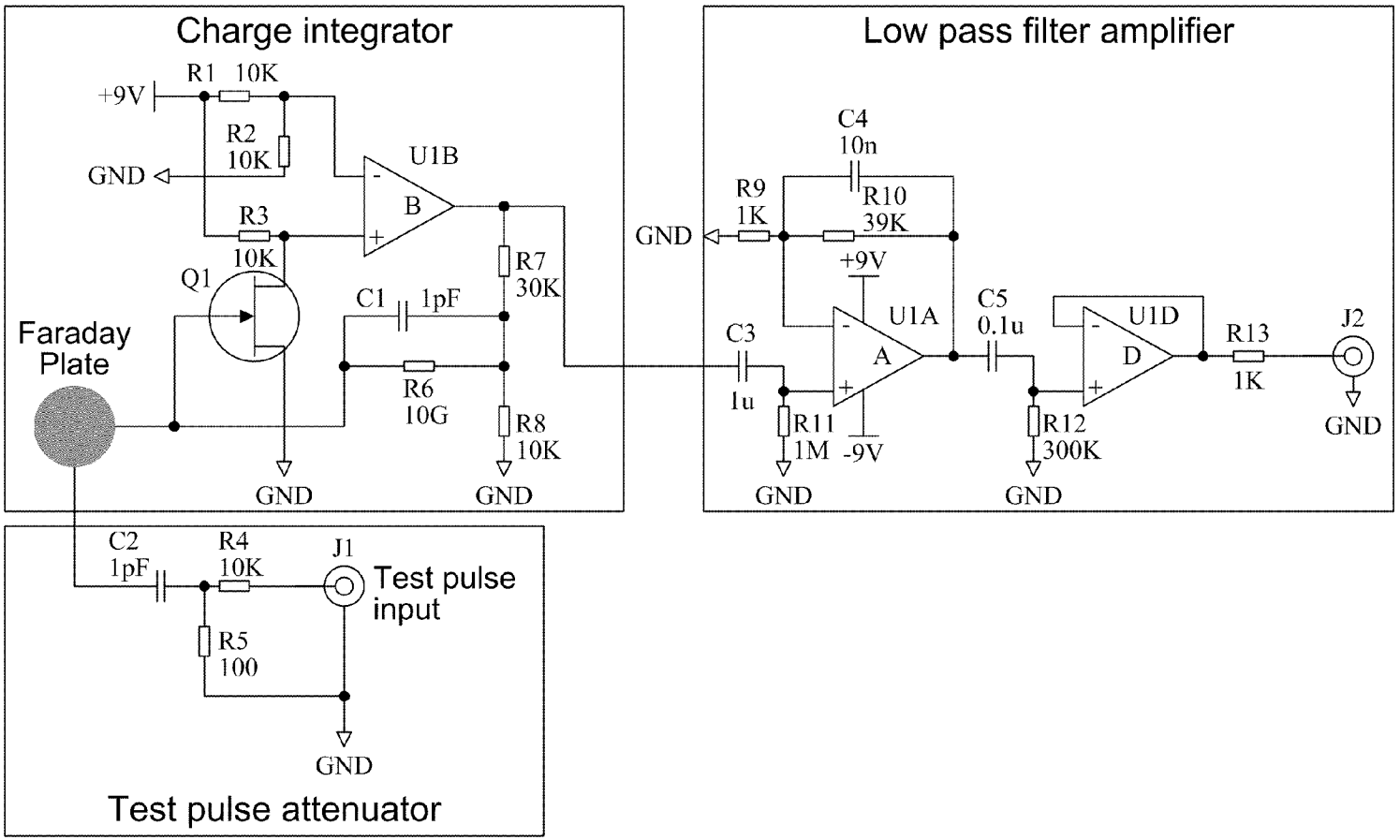

The circuitry of the exemplary charge detector is shown in FIG. 2B. Resistors are indicated by rectangles, capacitors by parallel bars, operational amplifiers by triangles containing + and − symbols, and one low noise Junction field effect transistor by a circle labeled as Q1. Elements are also identified by one or more letters and a number; initial letters of R, C, J, and U indicate resistors, capacitors, shielded coaxial connectors, and operational amplifiers, respectively. Small solid black circles indicate junctions. Connections to ground are indicated by a small triangle and the letters GND. +9V and −9V indicate positive and negative supply voltages supplied by battery, respectively. Resistances and capacitances are indicated in ohms and farads, respectively, adjacent to each symbol, where p, n, u, K, M, and G indicate pico-, nano-, micro-, kilo-, mega-, and giga-modifiers for the units as appropriate.

The charge-conversion gain of the charge-sensitive amplifier was calibrated using a calibration pulse with a known charge to simulate the correct charge-collection time of a detected signal as compared with actual measurements of desorbed cells and microparticles. The gain of the charge integrators was calibrated by applying a known voltage pulse across a known capacitance to simulate the incoming pulse shape. The charge-to-pulse-height conversion constant of the charge integrator was calibrated to be around 52 e $mV^{-1}$. The root-mean-square ("rms") output voltage noise was slightly lower than 10 mV, corresponding to an equivalent noise of about 500 electrons. With a mild corona discharge to increase charge attachment to cells or microparticles, the charge number on each microparticle was higher than 50,000, leading to a signal-to-noise ratio greater than 100.

With a charge-monitoring mass spectrometer, individual peaks in a mass spectrum should reflect their respective ion populations without detection bias. Since a charge-detection plate has no amplification by secondary electron emission, the charge-monitoring mass spectrometer of FIG. 1A equipped with such a charge-detection plate was able to obtain mass spectra without detection efficiency bias. The major limitation of the sensitivity of the instrument was the electronic noise. An electronic-noise level equivalent to 100 electrons has been reported.[6] With cooling of the charge-detection plate electronics, the noise level of the exemplary system can be expected to be reduced by a factor of about 5, e.g., to attain similar noise levels of around 100 electrons.

[6] S. D. Fuerstenau, Whole Virus Mass Analysis by Electrospray Ionization, *J. Mass Spectrom. Soc. Jpn.* 51:50-53 (2001); S. D. Fuerstenau and W. H. Benner, Molecular Weight Determination of Mega-Dalton Electrospray Ions using Charge Detection Mass Spectrometry. *Rapid Comm. Mass Spectrom.* 9:1528-1538 (1995).

Example 3

Mass Spectrometry of Nanoparticles

The charge-monitoring mass spectrometer shown in FIG. 1A and the charge detector of FIG. 2A were used to measure small desorbed molecules, such as fullerenes ($C_{60}$). The audio driving frequency was set to approximately 200 kHz, and approximately 20 mTorr helium buffer gas was applied to the quadrupole ion trap. A wide-band power amplifier was used to boost the radio-frequency amplitude to a constant voltage of 150 V, and the ion trap was floated to a DC bias of around 2000 V. No charge enhancement step was performed in this experiment. Since a small molecular ion produced by laser desorption usually has a single charge, the number of ions detected should reflect the true number of ions produced so that quantitative measurement can be achieved.

Figure 3A:
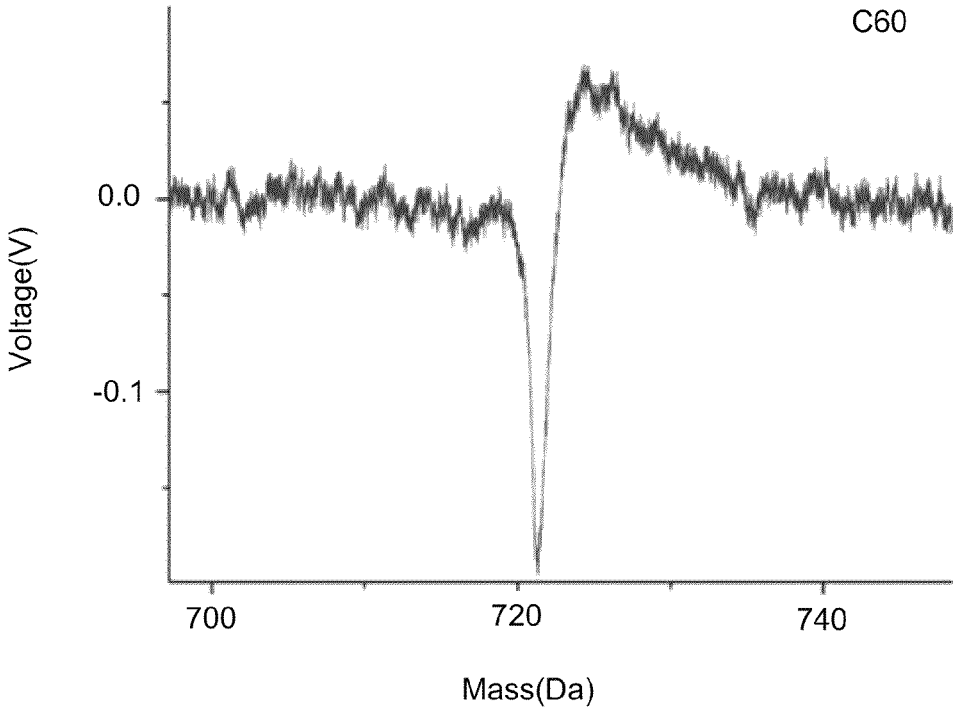
FIG. 3A is a graphical representation of an exemplary mass spectrum of fullerene ($C_{60}$) molecules that may be measured in accordance with the disclosed embodiments.

FIG. 3A shows an exemplary mass spectrum of $C_{60}$ that was measured using the apparatus shown in FIG. 1A. The mass spectrum in FIG. 3A indicates that small ions, such as $C_{60}$ ions, can be detected by a charge detector with good mass resolution ($m/\Delta m \approx 500$). The peak height indicates that there were ~15,000 $C_{60}$ mono-charged ions produced during the laser ablation process. The scan time for this spectrum was 1 second.

Example 4

Mass Spectrometry of Cancer Cells

The invention was used to determine the mass distribution of cancer cells, specifically, the leukemic cell line CEM. The CEM cells were washed with Dulbecco's phosphate-buffered saline (PBS, Gibco BRL) and fixed with 4% paraformaldehyde in PBS for 15 minutes at room temperature. Thereafter, the cells were washed three times in distilled deionized water and subsequently counted and resuspended before being placed into the mass spectrometer shown in FIG. 1A.

Figure 3B:
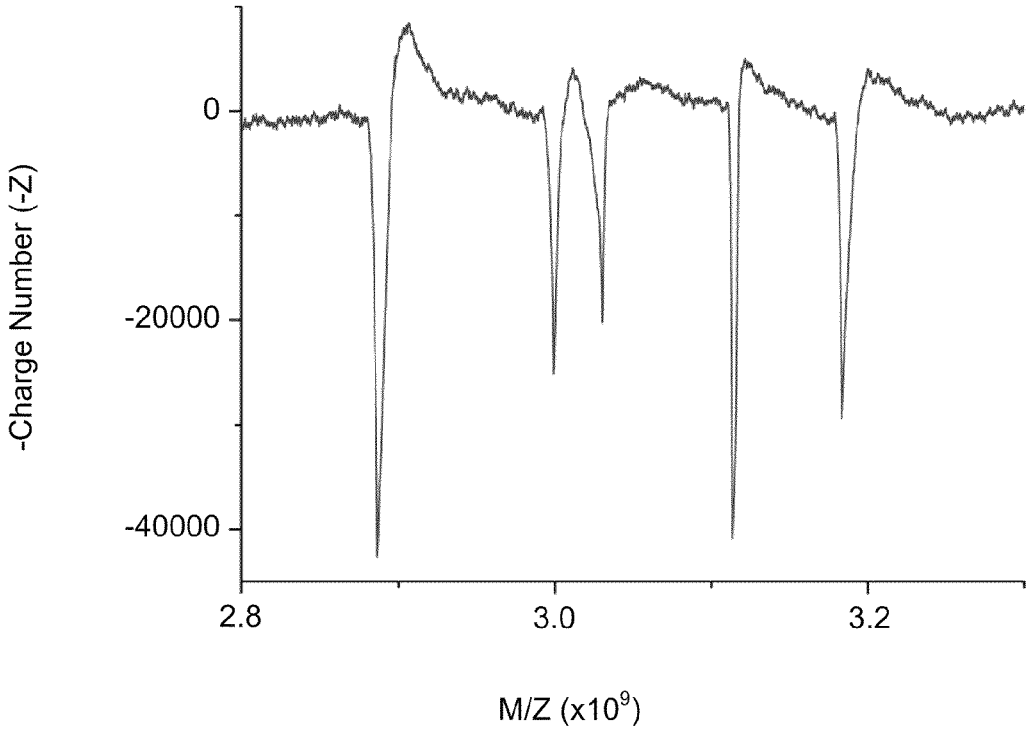
FIG. 3B is a graphical representation of an exemplary mass spectrum of CEM cells that may be measured in accordance with the disclosed embodiments.

The resulting mass spectrum of CEM cells is shown in FIG. 3B. Five peaks are shown. Each peak indicates a cell particle, and the peak height is the number of charges on the particle. The mass of each cell was calculated from simultaneous measurement of mass-to-charge ratio (m/z) and the charge (z). Each peak was associated with a specific m/z value determined by a corresponding ejection frequency. The number of charges on each desorbed CEM cell was derived from a detected signal amplitude at the charge-detection plate. There were about 10 CEM cells on average trapped by each laser pulse. The scanning rate was fixed at approximately 5 seconds to cover an entire audio frequency range, and the speed of mass measurements was estimated to be around 7200 analyte particles per hour, which was an improvement of three orders of magnitude over the earlier technique of light scattering measurement (e.g., around 2-4 cells or microparticles per hour).

Using the system of FIG. 1A, there occasionally were doublets trapped in the quadrupole ion trap. Since the number of charges on a doublet is about twice that of a single analyte, the m/z value should be about the same as that of a single analyte. Nevertheless, the amplitude corresponding to total charges was about double that of a single analyte. The mass obtained can be determined as a doublet. In contrast, a conventional mass spectrometer cannot distinguish between $M_2^{2+}$ and $M^+$, because no charge information can be obtained and m/z is identical for both types of ions.

Example 5

Mass Spectrometry of Microparticles

FIGS. 4A-H show mass and charge distributions for polystyrene microparticles having sizes of 3, 7.2, 10.1, and 29.6 μm. Each count represents a single detected microparticle. Fewer counts were obtained for 29.6 μm because it is more difficult to trap large particles due to gravity. Based on these distributions, the average masses were measured as $9.9\times10^{12}$, $1.3\times10^{14}$, $3.5\times10^{14}$, and $7.1\times10^{15}$ Da, respectively, which are in good agreement with the calculated masses of $8.8\times10^{12}$, $1.2\times10^{14}$, $3.4\times10^{14}$, and $8.6\times10^{15}$ Da, respectively. Further, the FWHM values (full width at half maximum) for the masses (Δm) of these polystyrene particles were measured to be $9.1\times10^{11}$, $2.3\times10^{13}$, $6.2\times10^{13}$, and $1.5\times10^{15}$ Da, respectively. A peak for a polystyrene dimer ($2.7\times10^{14}$ Da) may be observed in FIG. 4B and the population ratio of dimer to monomer was estimated to be around 11%.

Figure 4A:
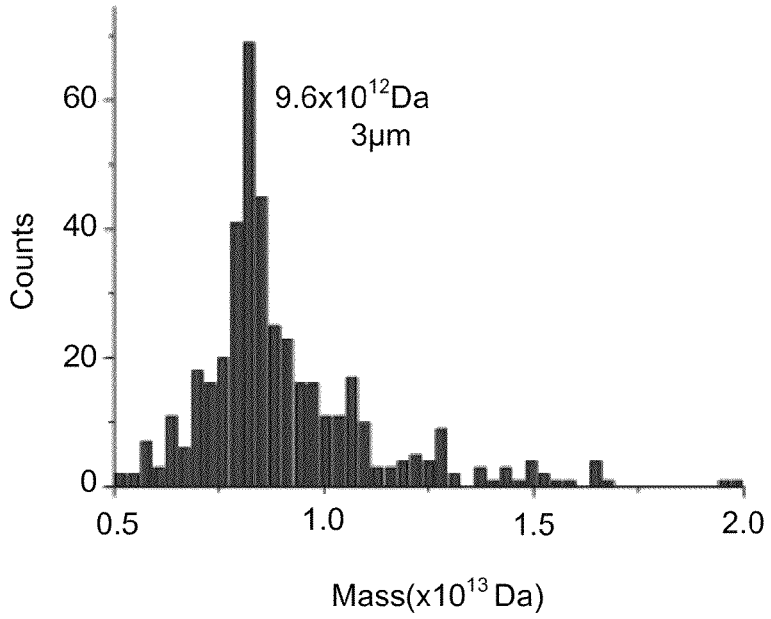
FIGS. 4A to 4D are histogram representations of exemplary mass distributions of 3, 7.2, 10.1, and 29.6 μm polystyrene microparticles, respectively, that may be measured in accordance with the disclosed embodiments.
Figure 4B:
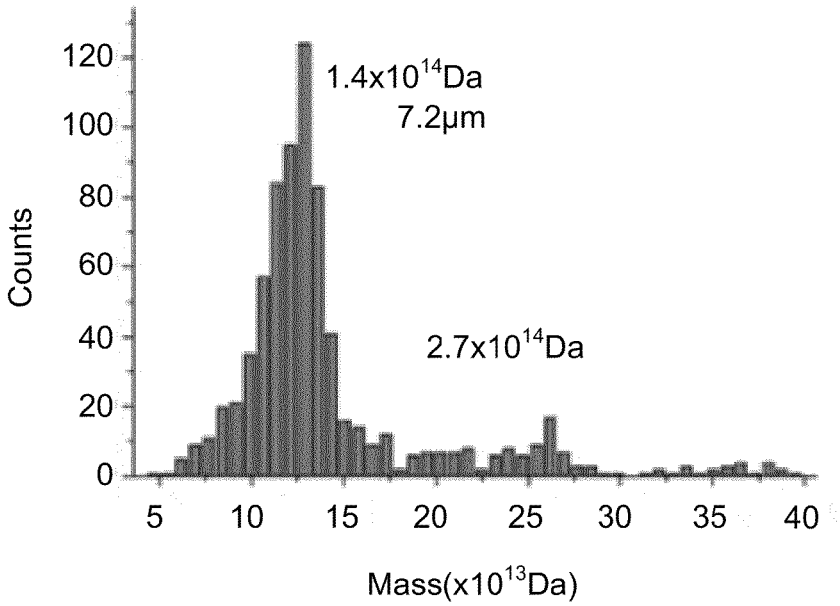
Figure 4C:
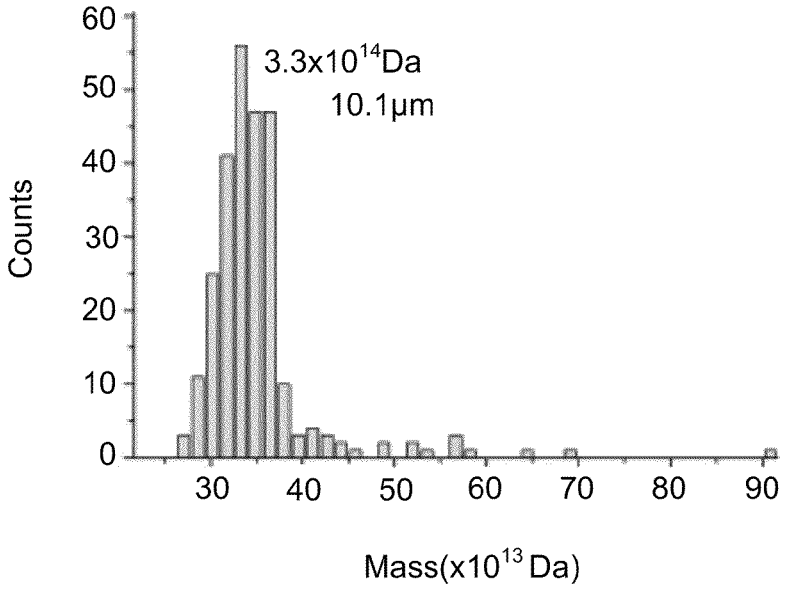
Figure 4D:
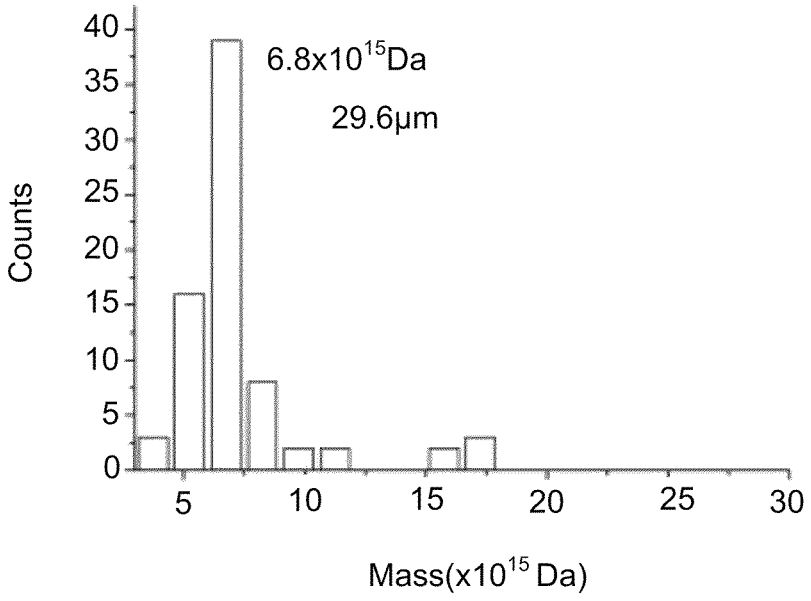
Figure 4E:
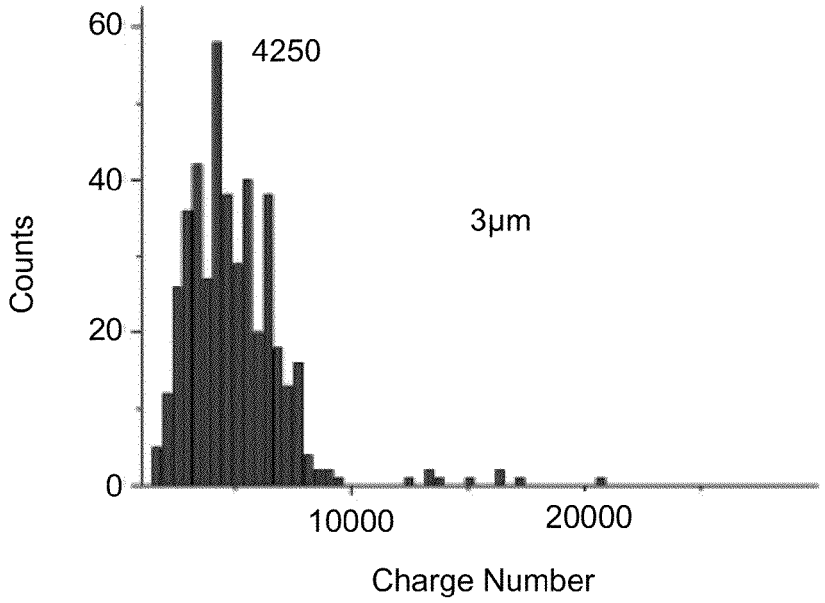
FIGS. 4E to 4H are histogram representations of exemplary charge distributions of 3, 7.2, 10.1, and 29.6 μm polystyrene microparticles, respectively, that may be measured in accordance with the disclosed embodiments.
Figure 4F:
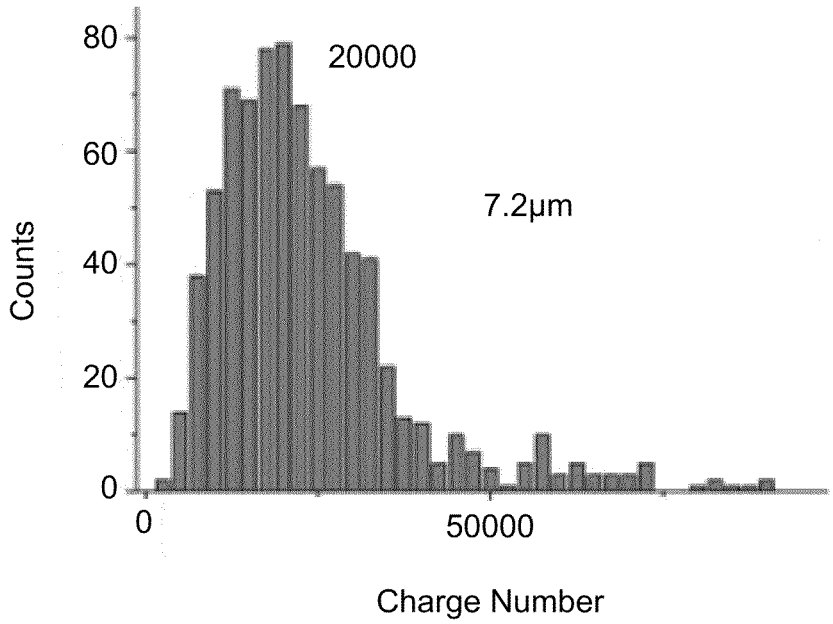
Figure 4G:
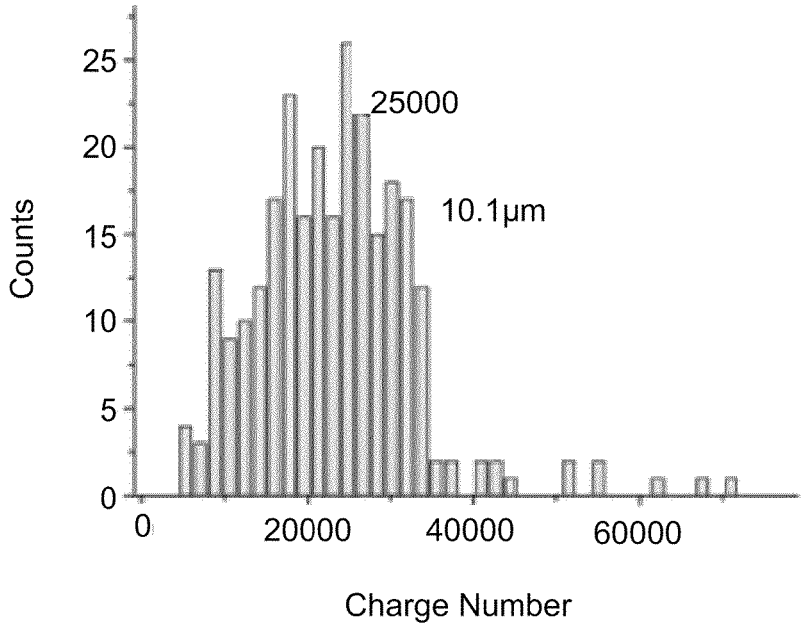
Figure 4H:
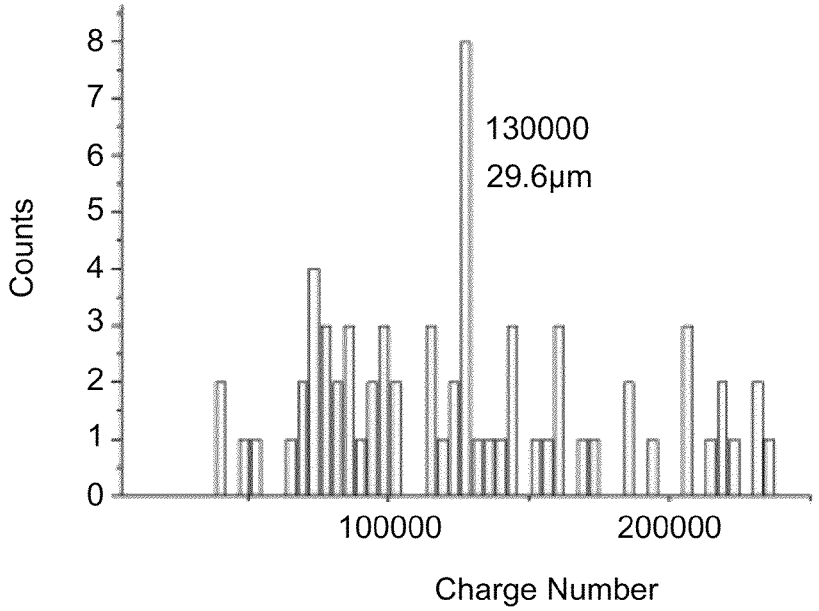

Distributions of the number of charges for different sizes of polystyrene are shown in FIGS. 4E through 4H. As shown, the number of charges increased with microparticle size, but was not necessarily proportional to the surface area of the microparticle. Moreover, as shown in FIG. 4H, the mass spectrometer was able to detect as many as 250,000 charges on a single 29.6-μm polystyrene microparticle.

Example 6

Mass Spectrometry of Lymphocytes and Monocytes

Figure 5:
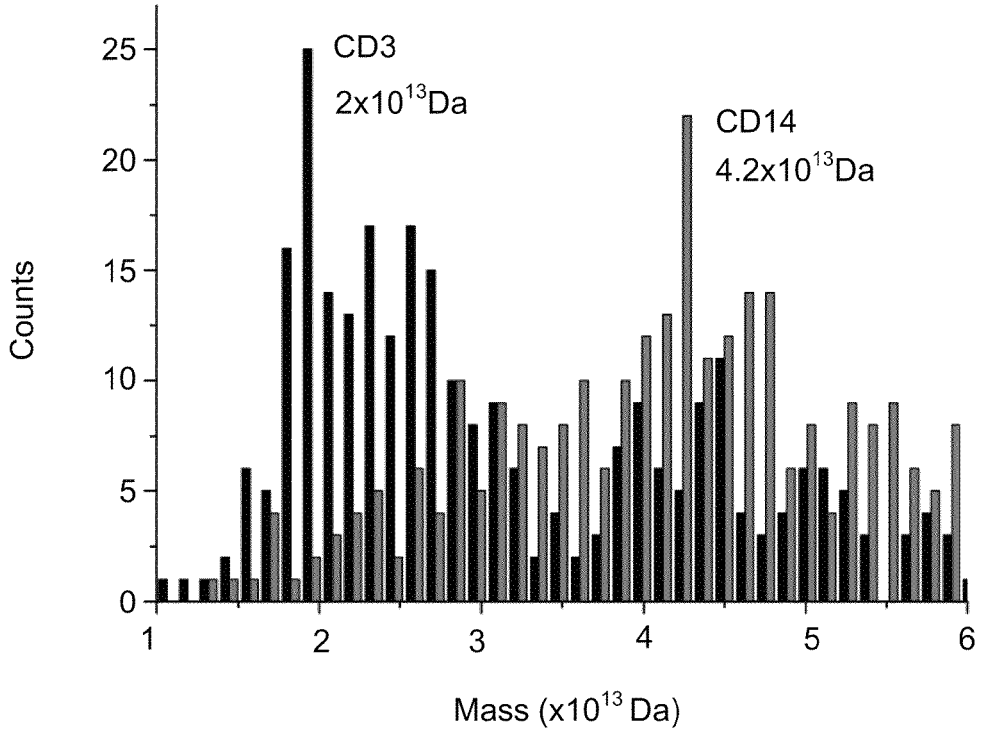
FIG. 5 is a histogram representation of exemplary mass distributions of lymphocyte (CD3+ cells, black) and monocyte (CD14+ cells, gray) that may be measured in accordance with the disclosed embodiments.

The mass distribution of various types of cells was also measured. For example, T lymphocyte (CD3+ cells) and monocyte (CD14+ cells) are major components of peripheral blood mononuclear cells, which play a critical role in the immune system. FIG. 5 shows mass distributions for $2\times10^{13}$ and $4.2\times10^{13}$ Da lymphocyte and monocyte cells, respectively, that were measured using the system of FIG. 1A. Because of the difference in their mass distributions, these two different types of cells can be clearly distinguished using the invention. Notably, since there is some overlap in the mass distributions of lymphocytes and monocytes, in some cases it may be difficult to identify a particular cell type by measuring the mass of only a few cells. Despite this caveat, the mass spectrometer was able to distinguish these two different types of cells.

Figure 6B:
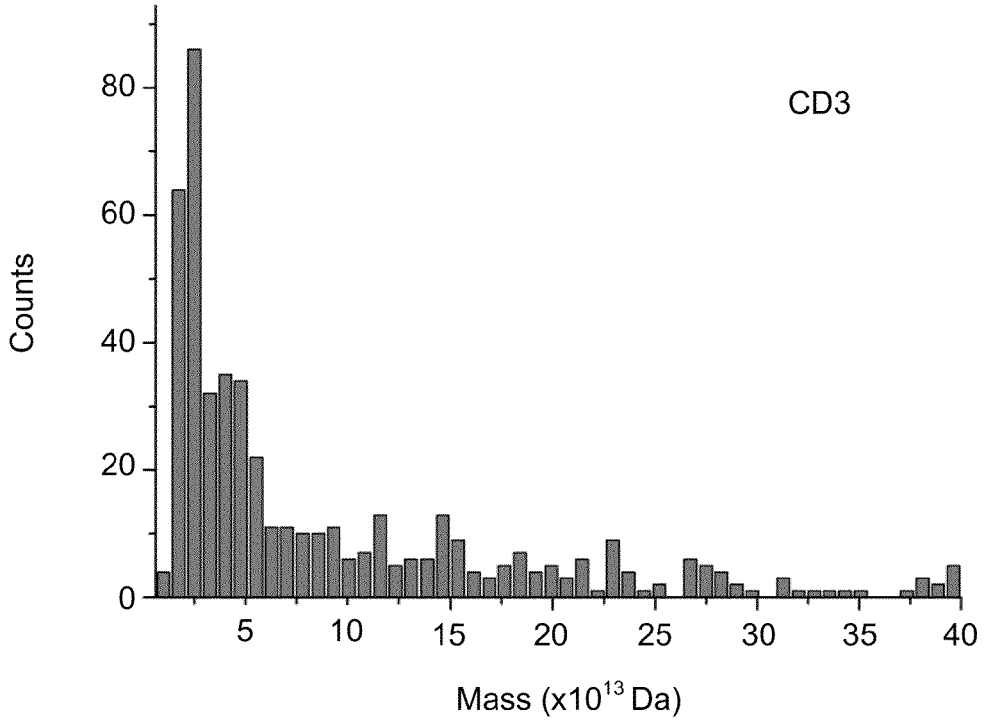
FIG. 6B is a histogram representation of an exemplary mass distribution of lymphocytes (CD3+ cells) that may be measured in accordance with the disclosed embodiments.
Figure 6C:
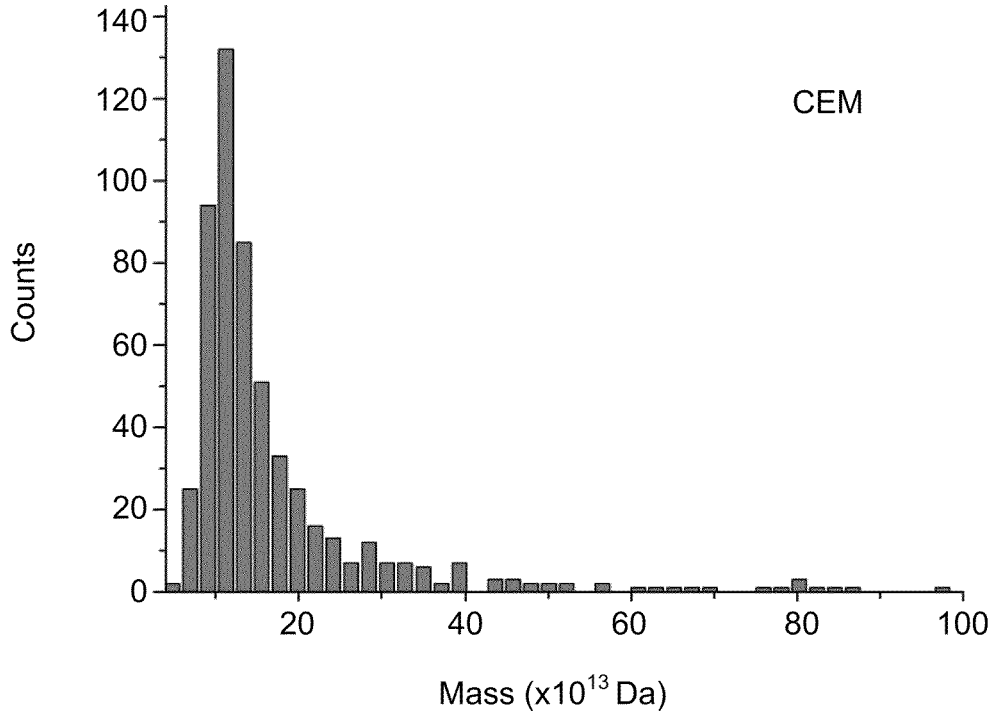
FIG. 6C is a histogram representation of an exemplary mass distribution of CEM cells that may be measured in accordance with the disclosed embodiments.

FIGS. 6A-C compare the mass distributions for CEM leukemia cells and normal lymphocytes (CD3+ cells). The mass distribution peaks of lymphocyte and CEM cells was determined to be $2.2\times10^{13}$ and $1.1\times10^{14}$ Da, respectively. As shown, the average mass of CEM cells was clearly larger than that of normal lymphocytes. Thus, it was possible for the system of FIG. 1A to easily distinguish CEM cells from normal lymphocytes.

Example 7

Mass Spectrometry of a Mixture of Different Cell Types

An equal number of CEM cells and lymphocyte (CD3+ cells) were mixed into a single sample. As shown in FIG. 6A, the histogram of such a mixed sample was almost the same as that obtained by adding the individual spectra of CEM and lymphocyte cells (FIGS. 6B-C), demonstrating that the mass spectrometer was able not only to measure a single kind of cell but also mixtures of cells. The size of CEM cells was measured with a particle-sizing device to be approximately 9.8±1.8 g/m in diameter, and the average cell weight in air was approximately $3\times10^{14}$ Da. These results suggest loss of intracellular water in the vacuum chamber of the quadrupole-ion-trap mass spectrometer. Also, the size distributions in FIG. 6A may not reflect true mass distributions since the density of a CEM cell may be different from that of a normal lymphocyte owing to its doubled number of chromosomes. The average number of electrons attached to a CEM cell was measured using the system of FIG. 1A to be approximately 45,000, which was about the same as that for a comparably sized polystyrene particle.

Figure 6D:
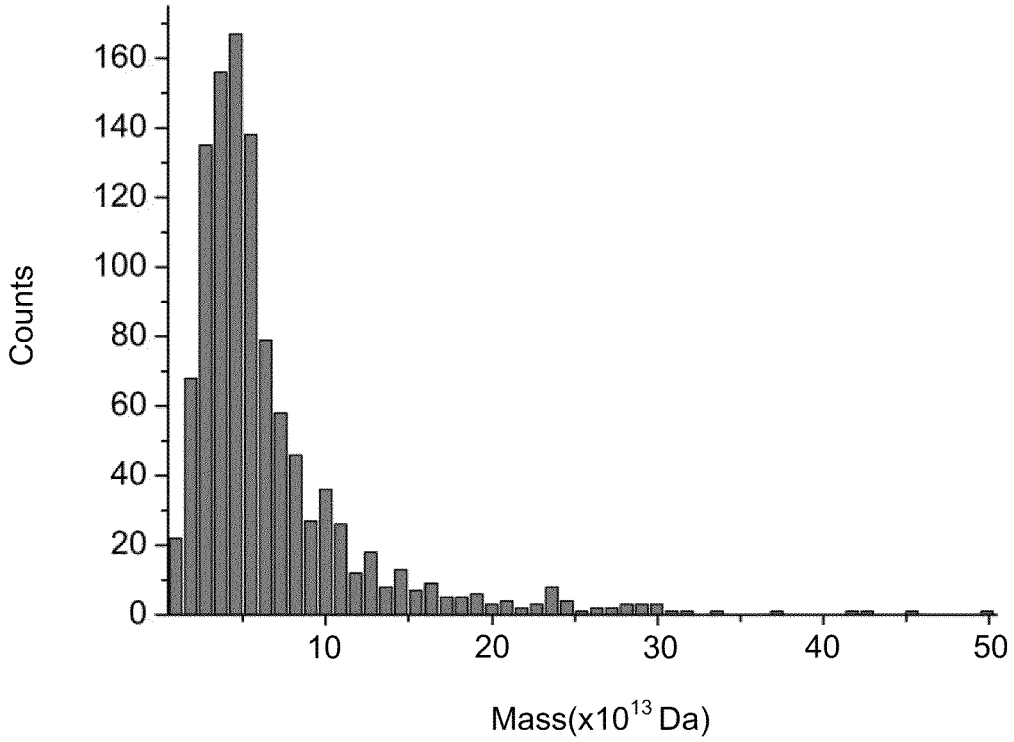
FIG. 6D is a histogram representation of an exemplary mass distribution of Jurkat cells that may be measured in accordance with the disclosed embodiments.
Figure 6E:
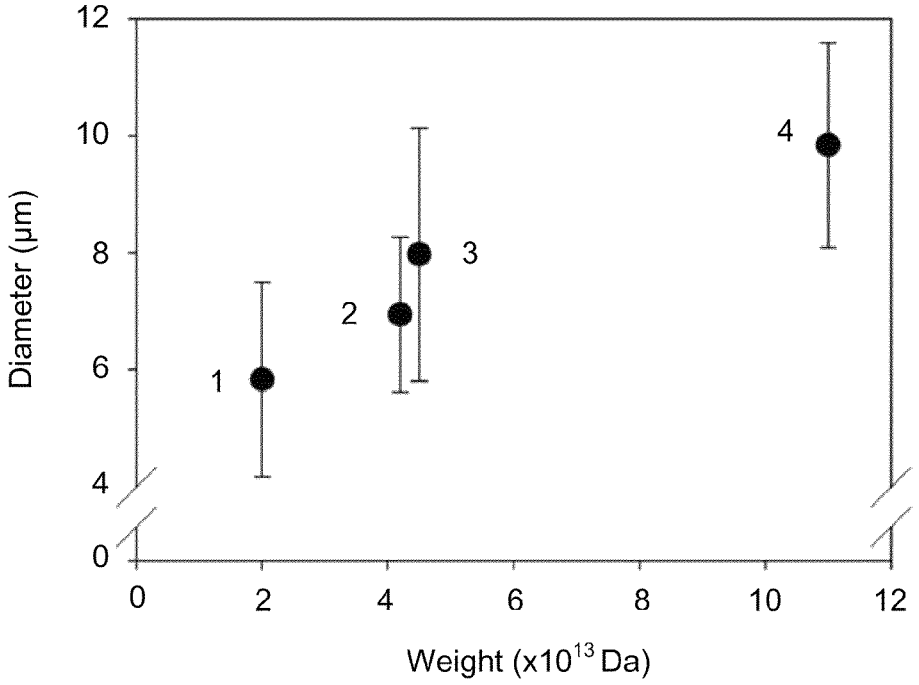
FIG. 6E is an exemplary graphical representation of cell size versus mass of lymphocytes (CD3+ cells) (1), monocytes (CD14+ cells) (2), Jurkat cells (3), and CEM cells (4) that may be measured in accordance with the disclosed embodiments.

As the sizes of lymphocyte, monocyte, and Jurkat were measured to be 5.8±1.7, 6.9±1.3, and 8.0±2.2 μm, respectively, based on the distributions shown in FIGS. 6A-C, it was expected that the average mass of Jurkat cells would be greater than that of monocytes. However, surprisingly, it was found that the mass peak position of Jurkat cells was around $4.5\times10^{13}$ Da (FIG. 6D), which was only 8% heavier than the monocyte mass peak position ($4.2\times10^{13}$ Da), even though Jurkat cells were 16% larger. FIG. 6E plots cell weight versus cell diameter. Although there was a general correlation between size and mass, the data in FIG. 6E did not fall perfectly along a straight line.

In sum, we have developed a novel charge-monitoring mass spectrometry system and method for rapid mass measurement of cells and microparticles. Different types of mononuclear cells (CD3+ lymphocytes and CD14+ monocytes) were clearly distinguished. Mass distributions were obtained to distinguish normal T lymphocyte from CEM cancer cells derived from T lymphocytes. The system allowed different types of analytes, including cells, microparticles, and nanoparticles to be distinguished on the basis of mass measurements. The measurement of the average mass of polystyrene microparticles with a size of 29.6 μm to be approximately $7\times10^{15}$ Da is among the largest masses reported so far with mass-spectrometric detection. Furthermore, more than 100,000 charges attached to a single 29.6-μm polystyrene particle were able to be observed using the system.

VII. Definitions

The following material explains how certain terms are used in this application.

An "analyte" is a particle, microparticle, nanoparticle, cell, cancerous cell, bacterium, virus, spore, organelle, ribosome, mitochondrion, chloroplast, synaptosome, chromosome, pollen grain, macromolecule, macromolecular complex, oligonucleotide, nucleic acid, protein, polysaccharide, polymer, dendrimer, aerosol particle, fine particulate object, molecule, other object, or mixture thereof being subjected to mass spectrometric analysis.

"Vaporization" is the process of mobilizing an analyte into the gas phase.

A "vaporizer" is a component or subsystem that effects vaporization.

An "electromagnetic field" is a field having an electrical component, a magnetic component, or both.

"Charge enhancement" means increasing the absolute charge on an analyte by at least twofold. For example, the number of charges may be increased by 2, 3, 4, 5, 7, 10, 20, 30, 40, 50, 60, 70, 80, 90, 100, or more times.

A "charge enhancer" is a component or subsystem that effects charge enhancement.

"Charge attachment" means alteration of the charge of an analyte by addition of charged particles such as electrons, protons, or ions.

A "mass analyzer" is a component or subsystem that is used for determination of analyte mass to charge ratio.

A "charge detector" is a component or subsystem that is used for determination of analyte charge.

The specification is most thoroughly understood in light of the teachings of the references cited within the specification. The embodiments within the specification provide an illustration of embodiments of the invention and should not be construed to limit the scope of the invention. The skilled artisan readily recognizes that many other embodiments are encompassed by the invention. All publications and patents cited in this disclosure are incorporated by reference in their entirety. To the extent the material incorporated by reference contradicts or is inconsistent with this specification, the specification will supersede any such material. The citation of any references herein is not an admission that such references are prior art to the present invention.

Unless otherwise indicated, all numbers expressing quantities of ingredients, reaction conditions, and so forth used in the specification, including claims, are to be understood as being modified in all instances by the term "about." Accordingly, unless otherwise indicated to the contrary, the numerical parameters are approximations and may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

Unless otherwise indicated, the term "at least" preceding a series of elements is to be understood to refer to every element in the series. Those skilled in the art will recognize, or be able to ascertain using no more than routine experimentation, many equivalents to the specific embodiments of the invention described herein. Such equivalents are intended to be encompassed by the following claims.

What is claimed is:

1. A method for performinga charge-monitoring mass spectrometry of analyte bioparticles, the method comprising:

a) preparing the analyte bioparticles by chemical fixation;

b) vaporizing and ionizing the analyte bioparticles by laser desorption from a desorption plate into a pressure controlled discharge to create analyte bioparticle ions in the presence of a buffer gas while applying a radiofrequency voltage of over 1000 V peak amplitude to a mass analyzer, thereby generating the pressure controlled discharge between the desorption plate and the mass analyzer that are held in the same chamber that contains the buffer gas, wherein the chamber is held at a pressure of the buffer gas from 10 to 100 mTorr, and wherein the pressure controlled discharge is adjacent to the mass analyzer;

c) determining the mass to charge ratio of the analyte bioparticle ions in the mass analyzer; and d) detecting the charge of the analyte bioparticle ions using a charge detector.

2. The method of claim 1, wherein the discharge is a corona discharge, a glow discharge, or an RF-induced discharge.

3. The method of claim 1, wherein the vaporizing is done by MALDI or laser induced acoustic desorption.

4. The method of claim 1, wherein the mass analyzer is a quadrupole ion trap or linear ion trap.

5. The method of claim 1, wherein the charge detector can operate without charge amplification.

6. The method of claim 1, wherein the charge detector is a Faraday plate or cup.

7. The method of claim 1, wherein the charge detector is an induction charge detector.

8. The method of claim 1, wherein the charge detector is a multiple stage induction charge detector.

9. The method of claim 1, wherein the charge detector conducting plate is cooled for increasing the signal to noise level.

* * * * *